United States Patent [19]

Gerber, Jr. et al.

[11] Patent Number: 4,470,327

[45] Date of Patent: Sep. 11, 1984

[54] ADJUSTABLE BALANCE HANDLE FOR KNIFE

[75] Inventors: Joseph R. Gerber, Jr.; James R. Raske, both of Lake Oswego, Oreg.

[73] Assignee: Gerber Legendary Blades, Portland, Oreg.

[21] Appl. No.: 563,131

[22] Filed: Dec. 19, 1983

Related U.S. Application Data

[62] Division of Ser. No. 413,664, Sep. 1, 1982, abandoned.

[51] Int. Cl.[3] ..... B21K 11/02

[52] U.S. Cl. ..... 76/104 R; 30/344

[58] Field of Search ..... 76/101 R, 104 R, 106; 30/340, 342, 344

[56] References Cited

U.S. PATENT DOCUMENTS

| | | | |
|---|---|---|---|
| 137,648 | 4/1873 | Ayers | 30/340 |
| 343,665 | 6/1886 | Leiter | 30/340 |
| 656,457 | 8/1900 | Hirsch | 30/342 |
| 664,175 | 12/1900 | Polchow | 30/344 |
| 1,167,387 | 1/1916 | Daniel | 273/81 A |
| 1,457,606 | 6/1923 | Schlehr | 30/342 |
| 1,997,131 | 4/1935 | Champlin | 30/342 |
| 2,142,137 | 1/1939 | Leary | 30/340 |
| 2,410,572 | 11/1946 | Echikson | 30/344 |

FOREIGN PATENT DOCUMENTS

| | | | |
|---|---|---|---|
| 120668 | 12/1945 | Australia | 30/340 |
| 11124 | 9/1956 | Fed. Rep. of Germany | 30/340 |
| 1102285 | 5/1955 | France | 30/343 |
| 394031 | 6/1933 | United Kingdom | 30/342 |

*Primary Examiner*—Roscoe V. Parker

*Attorney, Agent, or Firm*—Klarquist, Sparkman, Campbell, Leigh & Whinston

[57] ABSTRACT

An adjustable balance knife handle is integrally formed of a handle material (e.g., aluminum) formed in two mirror-image halves. Each half has a plurality of cavities disposed along its inner surface. Selected cavities are filled with a weighting material (e.g., lead) to adjust the balance and heft of the knife. Any remaining cavities are filled with a lightweight filler material (e.g., plastic foam) to exclude water from the handle.

4 Claims, 3 Drawing Figures

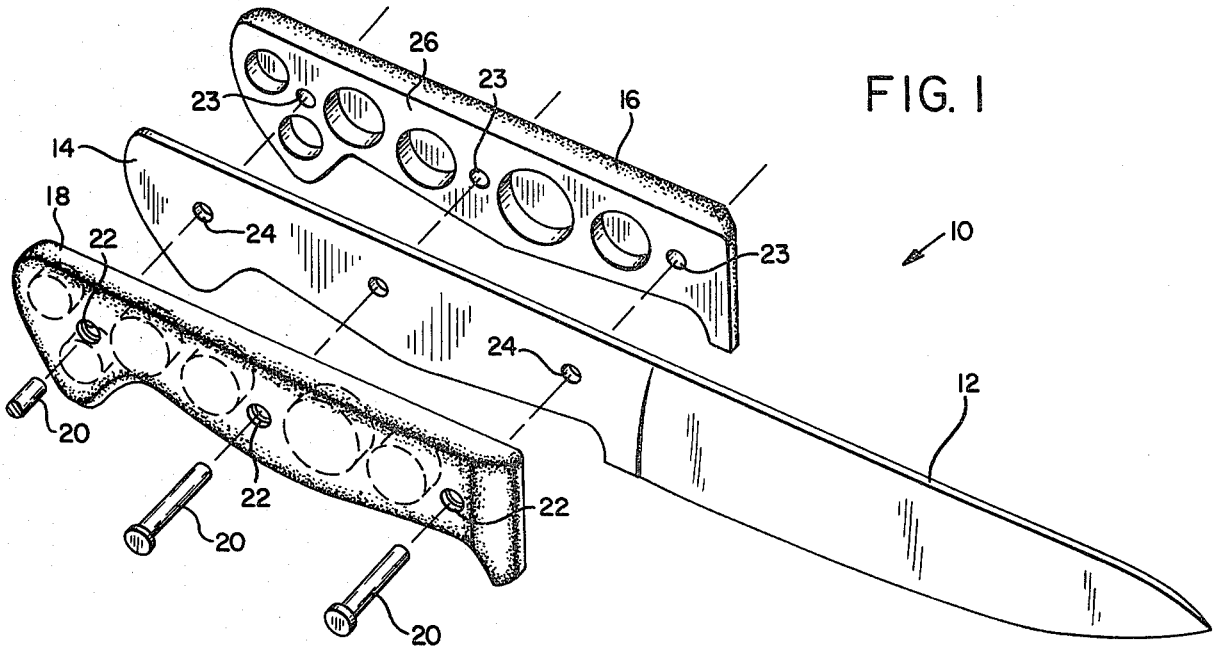
FIG. 1
FIG. 2
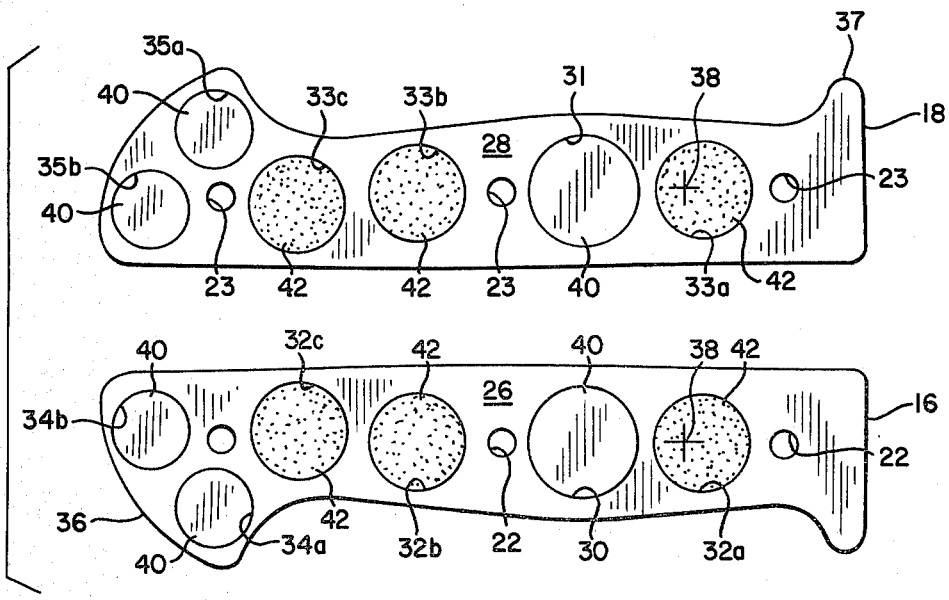
FIG. 3
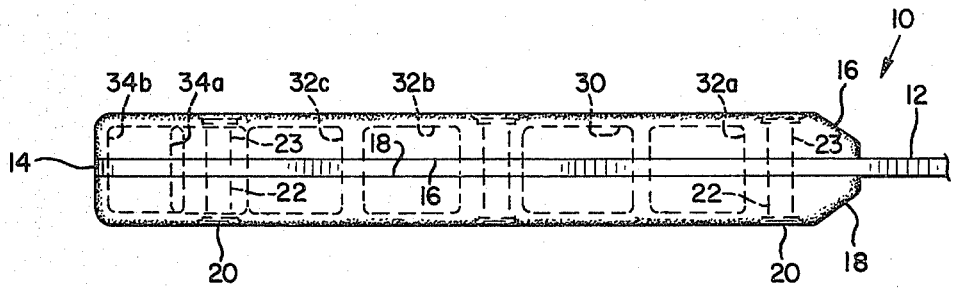

ADJUSTABLE BALANCE HANDLE FOR KNIFE

This is a division of application Ser. No. 413,664, filed Sept. 1, 1982 and now abandoned.

BACKGROUND OF THE INVENTION

This invention relates generally to knives and more particularly to an arrangement for adjusting the handling characteristics of knives.

Knives come in varying shapes and lengths and different kinds of knives are wielded in different ways to accomplish their respective purposes. For example, a boning knife has a blade which is relatively short and narrow and is used in a cutting action pivoting about the user's wrist. In contrast, a chef's knife has a relatively heavier and longer blade and is used in an action which typically pivots about the end of the blade. For comfort and ease of use, it is therefore desirable to impart in the construction of each type of knife a balance and heft commensurate with its dimensions and intended manner of use. The precise parameters of these characteristics, of course, will vary with the type of knife.

In the manufacture of a line of kitchen knives it is desirable to use similar or common parts, particularly in the handles of such knives. It is also desirable to utilize the same types of handle materials for such knives. Ideally, all handles used in a line of knives should be constructed in the same size, shape and material for making a matched set of knives. Knife handles in a matched set of knives are conventionally made of one type of material, whether it be plastic, wood, metal or other material. However, doing so makes it very difficult, at the same time, to impart the unique desired heft and balance characteristics in each type and size of knife within the product line. Conventionally, either the handles are made in different sizes and shapes, or for sake of economy, compromises are made in the handling characteristics of some of the knives.

Accordingly, there remains a need for an arrangement for optimizing the handling characteristics of different kinds and sizes of knives within a product line while retaining a high degree of commonality of parts and materials so that the knives can be made in matched sets.

SUMMARY OF THE INVENTION

It is therefore a first object of the invention to facilitate adjustment of the handling characteristics of knives to accommodate varying blade designs and dimensions and their commensurate uses.

A second object of the invention is to enable adjustment of the heft and balance of a knife without altering the size and shape of its handle.

A third object of the invention as aforesaid is to optimize the handling characteristics of knives having like handles composed of a common material.

In accordance with the invention, the foregoing objects are realized in a handle arrangement wherein the handle is divided lengthwise into two portions for sandwiching the tang of the blade therebetween, by providing each portion with one or more internal cavities opening toward the tang in a selected lengthwise position in the handle to adjust its heft and balance. These cavities can be left empty or selected cavities can be filled with weighting material. The handle and weighting materials have different densities for adjusting the center of gravity and total mass or heft of the knife. The internal cavity preferably comprises a plurality of separate cavities or compartments disposed lengthwise within each of the handle portions for receiving the weighting material in a selected one or more of the cavities. The balance or center of gravity of the knife is adjusted by selecting which cavities along the length of the handle are to be filled with the weighting material. The heft of the knife, and particularly of the handle, is controlled by selecting the number and size of cavities to be filled. Any cavities remaining unfilled, after the balance and heft have been optimally adjusted for the particular type and dimension of a given knife, are preferably filled with a filler material having a density much less than that of the handle portions so as to keep out water when the knife is submerged.

The foregoing and other objects, features and advantages of the invention will become more readily apparent from the following detailed description of a preferred embodiment which proceeds with reference to the accompanying drawing.

BRIEF DESCRIPTION OF THE DRAWINGS

FIG. 1 is an exploded perspective view of a knife in accordance with the invention.

FIG. 2 is a view taken along the interior surfaces of the handle portions of FIG. 1 showing selected cavities of such portions filled for use on an 8-inch cook's or chef's knife.

FIG. 3 is a top plan view of the knife of FIG. 1, as assembled, showing the configuration of the cavities in dashed lines.

DETAILED DESCRIPTION OF A PREFERRED EMBODIMENT

Referring to FIGS. 1 and 3, a knife 10 in accordance with the invention comprises a blade 12, including a tang 14, and a handle comprising two mirror image handle portions 16, 18 enclosing the sides of the tang. Rivets 20 conventionally extend through countersunk rivet holes 22, 24 in the handle portions and tang, respectively, to secure the handle portions to the knife blade. The knife blade can be of conventional shape and size and have either a full tang, as shown, or a partial tang.

Referring to FIGS. 2 and 3, the handle portions 16, 18 are preferably each integrally formed of a single material. The overall shape of the handle is conventionally contoured to fit an adult's hand and includes an enlarged butt end 36 and finger guard 37 integrally formed in opposite ends of the handle. The handle material is preferably cast aluminum having an anti-slip coating of baked vinyl or epoxy powder.

The handle portions have flat interior mating faces 26, 28 for tightly abutting the flat sides of tang 14. Cylindrical cavities 30, 32*a–c*, 34*a–b* are formed in handle portion 16 and each cavity has an entrance at mating face 26. Handle portion 18 is likewise provided with mirror image cavities 31, 33*a–c*, 35*a–b*, having entrances at face 28.

The dimensions of the cavities are preferably established in accordance with their position so as most advantageously to adjust the heft and balance of the knife. A relatively larger cavity 30, 31 is located inwardly adjacent the position of a user's middle finger for adjusting the heft of the handle without appreciably affecting its center of gravity. Similarly, relatively smaller cavities 34*a–b*, 35*a–b* are positioned in a butt portion of the handle for adjusting the center of gravity of the knife without appreciably affecting its heft. Additional cavities 32*a–c*, 33*a–c* of intermediate size are spaced along the length of the handle for making immediate adjustments in both heft and center of gravity.

In one example of the invention, cavities 30, 31 have a diameter of $\frac{3}{4}$ inch. Such cavities are located somewhat toward the blade from the midpoint of the handle, longitudinally adjacent the approximate position of the middle finger of a user grasping the handle in his fist with his index finger adjacent the finger guard. Cavities 32*a–c*, 33*a–c* are somewhat smaller, for example, $\frac{5}{8}$ inch diameter, and are spaced along the length of the handle so as to underlie the user's index, ring and small fingers, respectively. Cavities 34, 35 are positioned in butt portion 36 of the handle. These are the smallest cavities, for example, $\frac{1}{2}$ inch diameter. The depth of the cavities can vary with the thickness of the handle portions. A depth of $\frac{1}{4}$ inch is suitable for most purposes.

Operation

Selected cavities are filled with a weighting material 40, such as lead, to adjust the heft and balance of a knife of a given type and size. For example, referring to FIG. 2, for use on a wide-bladed cook's knife having an 8-inch blade, cavities 30, 31 are filled with lead to impart in the handle a heft commensurate with the size and weight of the blade. Cavities 34*a*, 34*b*, 35*a*, 35*b* are filled with lead to counterbalance the weight of the blade about the knife's center of gravity 38.

The knife's center of gravity can be shifted forwardly or rearwardly and its balance and heft altered by filling more or fewer of the cavities with lead. For knives having very light or very short blades, none of the cavities are filled with lead. There is no set formula for determining which cavities are to be weighted. This determination is made empirically by weighting various combinations of cavities in knives of a given size and type and testing the sample knives for optimum feel to a skilled user for the particular type of usage for which the knife is intended.

Any cavities remaining unfilled with lead are filled with suitable lightweight filler material 42, such as plastic foam, to exclude water from such cavities when the knife is washed.

The invention thus enables a handle of a single size, shape and material to be used in a matched set of knives having blades of different sizes and shape. At the same time, it affords complete freedom in adjusting the handling characteristics of the knives commensurately with their size, shape and customary usage.

Having illustrated and described a preferred embodiment of the invention, it should be apparent to those skilled in the art that the invention may be modified in arrangement and detail without departing from its principles. We claim as our invention all such modifications as come within the spirit and scope of the following claims.

We claim:

1. A method of making a knife having a predetermined balance characteristic and a handle of a standard size, shape and material, the handle being suitable for a variety of knives having blades of different sizes and shapes to form a matched set of knifes, comprising:

forming a blade of a desired size and shape with a flat tang of predetermined size and shape;

providing a pair of handle portions defining a handle of a first solid material in a size and shape conforming to the size and shape of the tang, the handle being suitable for a variety of knives in a matched set, the handle portions each having a longitudinally extending interiorly disposed planar inner surface for contacting the opposite sides of the tang and sandwiching the same therebetween, each of the handle portions being provided with a plurality of separate cavities interiorly thereof, the cavities being disposed generally lengthwise of the handle portion, each cavity having an entrance at the inner surface;

selectively filling at least one of the cavities in each handle portion with a second solid material having a density substantially greater than that of the first solid material to achieve a desired balance characteristic for the knife;

filling the remaining cavities in each handle portion with a lightweight material to exclude water from the cavities when the knife is washed; and sandwiching the tang between the handle portions and securing the same thereto.

2. A method as in claim 1 in which the lightweight material is plastic foam.

3. A method of making a matched set of knives wherein each knife in the set has a blade of a different size and shape but a handle of a common exterior size and shape and of a common material, whereby each knife in the set appears to have an identical handle, each knife in the set having a predetermined balance characteristic commensurate with the dimensions of the knife and its intended manner of use, comprising:

forming a plurality of knife blades each having a desired but different size and shape, each blade having a flat tang of a single predetermined size and shape;

providing a knife handle for each of the knife blades, each handle conforming to the size and shape of the tang, each handle being of a first solid material, each handle being of a common exterior size and shape, each handle being divided into a pair of handle portions along a longitudinally extending interiorly disposed planar surface for contacting the opposite sides of the tang and sandwiching the same therebetween, each of the handle portions being provided with a plurality of separate cavities interiorly thereof, the cavities being disposed generally lengthwise of the handle portions, each cavity having an entrance solely at the interiorly disposed planar surface of the handle portions whereby the presence of the cavities is invisible when the handle portions contact the opposite sides of the tang;

selectively filling at least one of the cavities in each handle portion with a second solid material having a density substantially greater than that of the first solid material to achieve a desired but different balance characteristic for each knife in the set;

sandwiching the tang of each knife blade between the handle portions of its respective handle; and securing the respective handle portions to each said tang.

4. A method as in claim 3 in which the cavities in each handle portion are mirror images of those in the other handle portion and the cavities that are filled with the second solid material in each handle portion are opposed to each other.

* * * * *